US006487948B1

(12) United States Patent
Alfi

(10) Patent No.: US 6,487,948 B1
(45) Date of Patent: Dec. 3, 2002

(54) FOOD SCORING KNIFE AND METHOD FOR SCORING

(76) Inventor: Elias A. Alfi, 4449 Romero Dr., Tarzana, CA (US) 91356

( * ) Notice: Subject to any disclaimer, the term of this patent is extended or adjusted under 35 U.S.C. 154(b) by 0 days.

(21) Appl. No.: 09/420,519

(22) Filed: Oct. 18, 1999

(51) Int. Cl.[7] ..... B26B 3/00
(52) U.S. Cl. ..... 83/13; 30/317; 30/2
(58) Field of Search ..... 30/294, 2, 289, 30/317, 340, 342, 343, 344, 392, 393; D8/98; 83/13

(56) References Cited

U.S. PATENT DOCUMENTS

| | | | | | |
|---|---|---|---|---|---|
| D49,724 | S | | 10/1916 | Curtiss | |
| 2,339,843 | A | * | 1/1944 | Dillon | |
| D141,109 | S | | 5/1945 | Doniger | D22/3 |
| D161,633 | S | | 1/1951 | Kevorkian et al. | D22/3 |
| D176,983 | S | | 2/1956 | Huxtable | D22/3 |
| 2,743,523 | A | * | 5/1956 | Honey | |
| 2,853,778 | A | * | 9/1958 | Pratt et al. | |
| D227,544 | S | | 7/1973 | Sumida | D8/98 |
| D227,545 | S | | 7/1973 | Sumida | D8/98 |
| 4,184,248 | A | | 1/1980 | Wolfe | 30/340 |
| 4,202,095 | A | | 5/1980 | Gingras | 30/340 |
| D267,622 | S | | 1/1983 | Russell | D7/151 |
| 4,373,263 | A | * | 2/1983 | Ayers | 30/294 |
| D269,154 | S | | 5/1983 | Freedman et al. | D8/98 |
| 4,408,396 | A | | 10/1983 | Scholl | 30/294 |
| 4,713,884 | A | * | 12/1987 | Dunnagan | 30/294 |
| D366,089 | S | | 1/1996 | Ackerson, Jr. et al. | D22/118 |
| D379,914 | S | | 6/1997 | Bloch | D8/98 |
| 5,697,157 | A | * | 12/1997 | Votolato | 30/2 |
| D391,821 | S | * | 3/1998 | Schultz | D8/98 |
| D397,018 | S | | 8/1998 | Mosley | D8/107 |
| D407,268 | S | | 3/1999 | Juhlin et al. | D7/401.2 |
| D416,440 | S | | 11/1999 | Juhlin et al. | D7/401.2 |

* cited by examiner

*Primary Examiner*—Kenneth E. Peterson
(74) *Attorney, Agent, or Firm*—Christie, Parker & Hale, LLP

(57) ABSTRACT

A food scoring knife of the presently preferred embodiment has an ergonomic handle portion and a head portion. A bottom edge of the handle portion is convex, while a bottom edge of the head portion is linear. During scoring, the user applies gentle pressure to the scoring knife, in particular, by placing fingers on a tapered finger rest, and at gripping indented sides of the handle portion. A tapered blade in the bottom edge of the head portion has a sharp cutting edge angled back toward the handle portion. The sharp edge slashes the surface of the food item as the scoring knife is pulled by the user. The convex bottom edge helps the user avoid dragging a bottom surface of the handle portion along the food item while scoring.

5 Claims, 1 Drawing Sheet

FOOD SCORING KNIFE AND METHOD FOR SCORING

FIELD OF THE INVENTION

The present invention relates to a food scoring knife, in particular, an ergonomic food scoring knife for scoring bread dough.

BACKGROUND OF THE INVENTION

In order to facilitate rising in the desired area of the loaf, and to avoid bulging, cracking, and exploding of the expanding loaf, the surface of the bread dough needs to be slashed. When the surface is slashed, the dough is able to vent and release pressure built up in the dough caused by the oven heat during the baking process.

The dough is generally slashed down the middle of the loaf, and/or around the sides. Decorative slashes are often used for bread such as baguettes. These decorative slashes are diagonally placed at spaced apart intervals along the top surface of the dough.

In an effort to avoid the dreaded explosion in the baking oven, the user often slashes the dough too deeply using a standard kitchen knife. The dough should be slashed to a depth that does not exceed about ¼ inch, which would seem to be too shallow to the untrained baker. It is therefore desired to have an instrument that slashes dough to a maximum depth of about ¼ inch.

SUMMARY OF THE INVENTION

A food scoring knife of the presently preferred embodiment has an ergonomic handle portion and a head portion. A bottom edge of the handle portion is convex, while a bottom edge of the head portion is linear. During scoring, the user applies gentle pressure to the scoring knife, in particular, by placing fingers his paper or fee is being deposited with the on a tapered finger rest, and at gripping indented sides of the handle portion. A tapered blade in the bottom edge of the head portion has a sharp cutting edge angled back toward the handle portion. The sharp edge slashes the surface of the food item as the scoring knife is pulled by the user. The convex bottom edge helps the user avoid dragging a bottom surface of the handle portion along the food item while scoring.

BRIEF DESCRIPTION OF THE DRAWINGS

These and other features of the present invention will be better understood from the following detailed description and accompanying drawings, wherein.

DETAILED DESCRIPTION OF THE INVENTION

Figure 2:
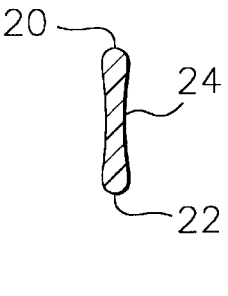
FIG. 2 is a cross-sectional view of the food scoring knife of FIG. 1.
Figure 1:
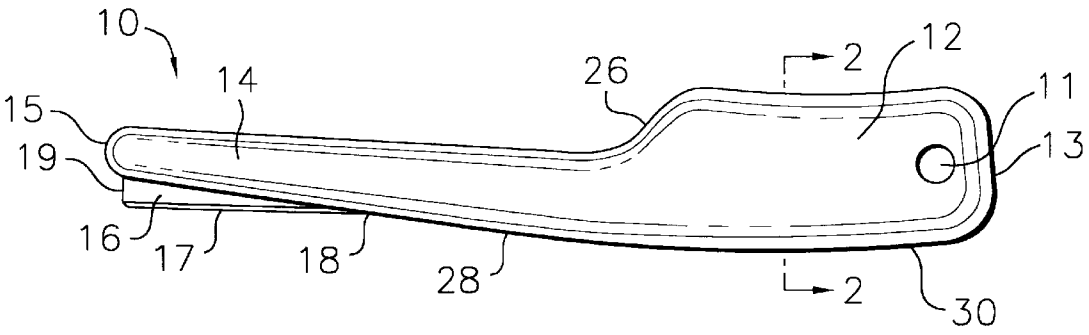
FIG. 1 is a side view of a food scoring knife according to a first preferred embodiment of the present invention.

In a first preferred embodiment shown in FIG. 1, a food scoring knife 10 has a handle portion 12 and a head portion 14. On a rounded top surface 20 of the scoring knife, in between the handle portion 12 and the head portion is a tapered section 26 provided for a finger rest. The finger rest allows the user to apply pressure from the index finger to the scoring knife. FIG. 2, the cross-sectional view of FIG. 1, illustrates that the handle portion has indented sides 24 allowing the user to easily grip the scoring knife with the thumb and middle finger, and to hold onto the scoring knife 10 while scoring.

In the preferred embodiment, the scoring knife has a rounded bottom surface 22 that allows the scoring knife to travel over the food item without tearing. The rounded top surface 20 allows the user's fingers to be comfortably placed thereon while using or holding the scoring knife.

A bottom edge 30 of the handle portion is convex (a curve bulging outward along the bottom of the handle portion), while a bottom edge 28 of the head portion is linear. While scoring the food item, the linear bottom edge 28 runs naturally parallel to the surface of the dough. As a result, the curved bottom edge 30 is spaced above the dough surface, and aids in avoiding contact between the handle portion and the dough (which can cause tearing of the dough) or a pan edge (which can cause an abrupt stop in the scoring motion). The advantages of the curved bottom edge 30 also include an ergonomic design, in that the user can hold the handle from a more comfortable and controllable higher position.

Preferably, the handle portion 12 has a back end 13 with a hole 11 therein. The hole not only serves the function of providing for a means of storing the scoring knife on a hook or nail, but also serves a safety function as described below. A tapered blade 16, described in more detail below, on the head portion of the scoring knife has a sharp edge 17 placed at an angle with the head portion. If the user were to pick up the scoring knife from the head portion, injury could result. The hole helps the user identify the handle portion of the scoring knife, so that the user will more likely grab the scoring knife from the handle portion.

The blade 16 is fixed in the head portion along the linear bottom edge 28. The blade is angled relative to the linear bottom edge 28 so that the blade tapers toward the handle portion. Therefore, the blade 16 has a protruding end 19 near a front 15 of the head portion and a tapered end 18 toward the handle portion. The advantage of the tapered blade is that the dough is easier to cut. If a straight blade (where the sharp edge of the blade is parallel with the linear bottom edge 28) were used, the slashing into the dough would likely tear the dough, because when the scoring knife is pulled through the dough, the cutting edge would actually be the side of the blade rather than the sharp edge 17. In contrast, the tapered blade has the sharp edge 17 as the cutting edge, and also gradually penetrates the dough, so that tearing is avoided.

Figure 3:
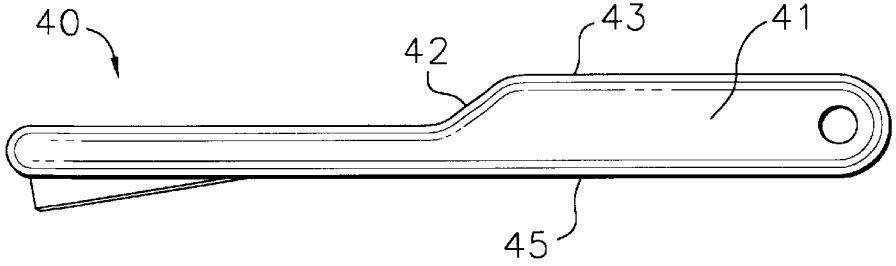
FIG. 3 is a side view of a food scoring knife according to a second preferred embodiment of the present invention.

In a second preferred embodiment shown in FIG. 3, a food scoring knife 40 has features similar to that of the first preferred embodiment, except for the shape of a handle portion. A handle portion 41 of food scoring knife 40 has a bottom edge 45 that is linear along the entire length of the bottom of the knife 40. In addition, a top edge 43 of the handle portion is preferably substantially parallel to the bottom edge. In between the handle portion 41 and the head portion is a tapered section 42 provided for a finger rest similar to finger rest 26.

Figure 4:
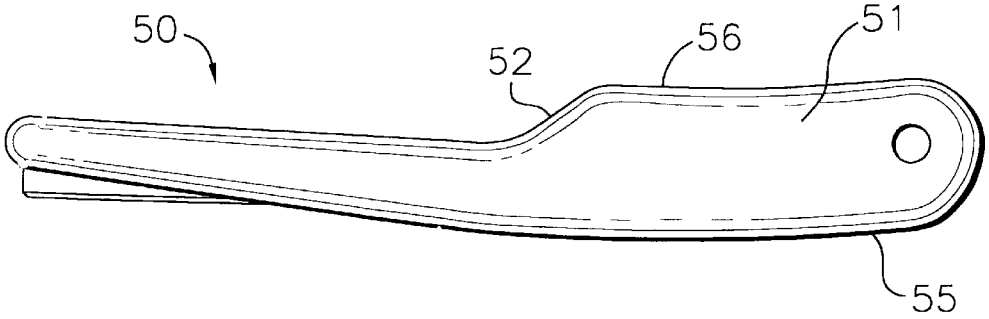
FIG. 4 is a side view of a food scoring knife according to a third preferred embodiment of the present invention.

In a third preferred embodiment shown in FIG. 4, a food scoring knife 50 also has features similar to that of the first preferred embodiment, except for the shape of a handle portion. A handle portion 51 has a bottom edge 55 similar to the curved bottom edge 30 of the first embodiment. However, a top edge 56 of the handle portion is more linear as compared with the first embodiment. The advantage of the linear top edge of the handle portion is that the packaging of the scoring knife 50 is more compact. In between the handle portion 51 and the head portion is a tapered section 52 provided for a finger rest similar to finger rest 26.

Preferably, a food item is scored by placing the tapered end of the blade at a far edge of the food item. During scoring, the user applies gentle pressure to the scoring knife, in particular, by placing fingers on a tapered finger rest, and at gripping indented sides of the handle portion. The sharp edge slashes the surface of the food item as the scoring knife is pulled by the user.

What is claimed is:

1. A method of scoring dough, comprising:

providing a food scoring knife comprising;

an elongated body having proximal and distal ends and comprising a handle portion at its proximal end and a head portion at its distal end, the handle portion having a height greater than the head portion, the body having a top edge and a generally rectangular end cross-sectional area with a bottom edge that extends along the length of the body, the bottom end being curved and generally smooth along its entire length; and an exposed blade having a bottom edge that is generally parallel to at least a portion of the top edge of the body and proximal and distal ends, the blade extending from a portion of the bottom edge of the head portion of the body near the distal end of the body and permanently attached to the body, wherein the height of the distal end of the exposed blade is greater than the height of the proximal end of the exposed blade;

wherein the distal end of the body and the bottom edge of the body having a junction that is curved, the curved junction extending beyond the distal end of the exposed blade; and pulling the knife over the dough so that the bottom edge of the body is in contact with the dough, whereby the exposed blade penetrates the dough and the body does not penetrate the dough.

2. A method according to claim 1, wherein the body of the knife is made of plastic.

3. A method according to claim 1, wherein the head portion of the knife has proximal and distal ends and decreases in height from its proximal end to its distal end.

4. A method according to claim 1, wherein the head portion of the knife has a length greater than the length of the handle portion.

5. A method according to claim 1, wherein the exposed blade of the knife has a height no greater than about 0.25 inch.

* * * * *